US007229726B2

(12) United States Patent
Caspar

(10) Patent No.: US 7,229,726 B2
(45) Date of Patent: Jun. 12, 2007

(54) THERMAL IMAGING PROCESS AND PRODUCTS MADE THEREFROM

(75) Inventor: Jonathan V. Caspar, Henry Clay Village, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/992,858

(22) Filed: Nov. 19, 2004

(65) Prior Publication Data

US 2005/0158652 A1 Jul. 21, 2005

Related U.S. Application Data

(60) Provisional application No. 60/526,195, filed on Dec. 2, 2003.

(51) Int. Cl.
*G03F 7/34* (2006.01)
*G03F 7/38* (2006.01)

(52) U.S. Cl. ..... 430/7; 430/200; 430/201; 156/234; 156/235; 428/32.5; 503/227

(58) Field of Classification Search ..... 430/7, 430/200, 201; 156/234, 235; 428/32.5; 503/227

See application file for complete search history.

(56) References Cited

U.S. PATENT DOCUMENTS 4,541,830 A 9/1985 Hotta et al.
4,643,917 A 2/1987 Koshizuka et al.
4,695,287 A 9/1987 Evans et al.
4,698,651 A 10/1987 Moore et al.
4,701,439 A 10/1987 Weaver et al.
4,743,582 A 5/1988 Evans et al.
4,753,922 A 6/1988 Byers et al.
4,757,046 A 7/1988 Byers et al.
4,769,360 A 9/1988 Evans et al.
4,772,582 A 9/1988 Deboer
4,775,657 A 10/1988 Harrison et al.
4,778,128 A 10/1988 Wright et al.
4,942,141 A 7/1990 Deboer et al.
4,948,776 A 8/1990 Evans et al.
4,948,777 A 8/1990 Evans et al.
4,948,778 A 8/1990 Deboer
4,950,639 A 8/1990 Deboer et al.
4,952,552 A 8/1990 Chapman et al.
5,019,549 A 5/1991 Kellogg et al.
5,126,760 A 6/1992 Deboer
5,156,938 A 10/1992 Foley et al.
5,166,026 A 11/1992 Fuller et al.
5,171,650 A 12/1992 Ellis et al.

(Continued)

FOREIGN PATENT DOCUMENTS

GB 2083726 3/1982

(Continued)

*Primary Examiner*—Richard L. Schilling
(74) *Attorney, Agent, or Firm*—Thomas H. Magee

(57) ABSTRACT

The invention relates to a method for thermally transferring an imaging material from an imaging donor to a receiver to form a pattern of the imaging material on the receiver in which a transparent texturing material is thermally transferred, preferably by laser exposure, from a texturing donor to the receiver prior to thermally transferring the imaging material to the receiver.

6 Claims, 5 Drawing Sheets

U.S. PATENT DOCUMENTS 5,516,622 A 5/1996 Savini et al.
5,521,035 A 5/1996 Wolk et al.
5,580,693 A 12/1996 Nakajima et al.
5,614,463 A 3/1997 Kawasaki et al.
5,935,758 A 8/1999 Patel et al.
5,976,698 A 11/1999 Staral et al.
6,242,140 B1 6/2001 Kwon et al.
6,270,944 B1 * 8/2001 Wolk et al. ..... 430/273.1
6,407,037 B1 * 6/2002 Prugh et al. ..... 503/227
6,563,556 B2 5/2003 Nikol et al.

FOREIGN PATENT DOCUMENTS

WO WO 90/12342 10/1990
WO WO 02/09948 2/2002
WO WO 03/098351 A1 11/2003

* cited by examiner

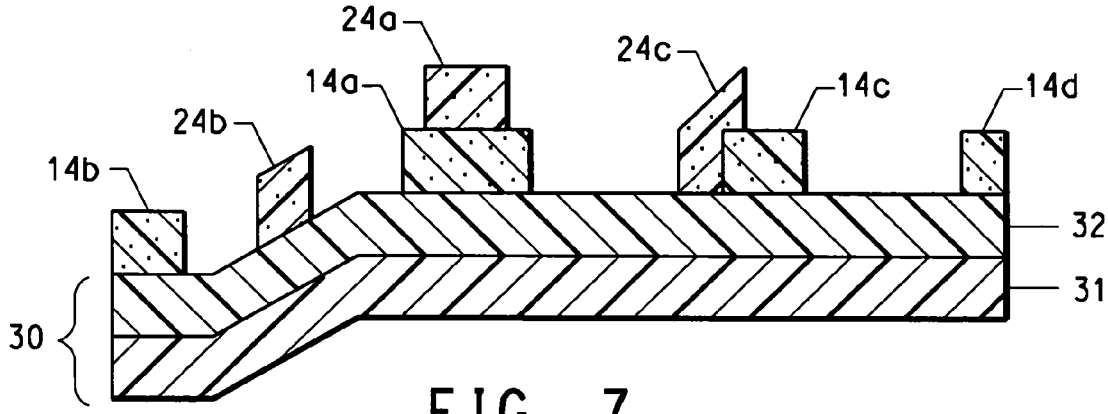
FIG. 7
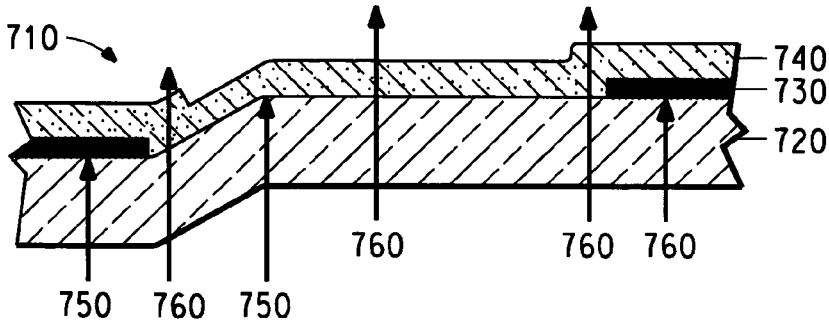
FIG. 8a
(PRIOR ART)
FIG. 8b
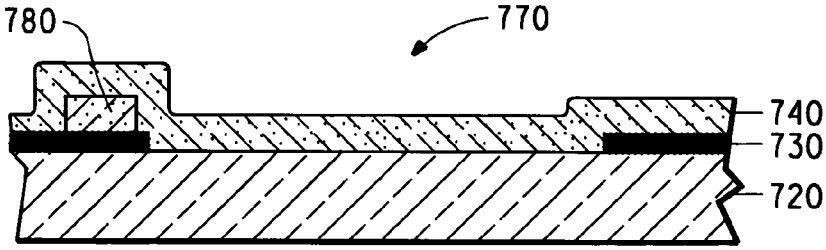
FIG. 8c
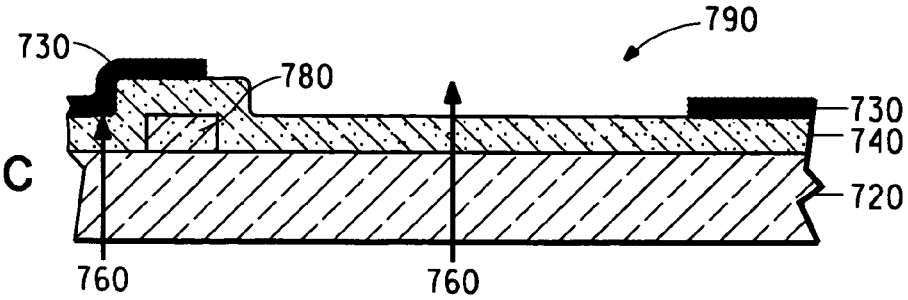

THERMAL IMAGING PROCESS AND PRODUCTS MADE THEREFROM

BACKGROUND OF THE INVENTION

The invention relates to a method for the manufacture of a thermal transfer element. More specifically, the invention relates to the use of a texturing donor to improve the thermal transfer process.

In known thermal transfer processes an imaging material, typically a pigment, is thermally transferred, using a laser, from a donor element to a receptor element. Such laser induced thermal transfer processes have been described for use in manufacturing various elements including monochrome or color prints, proofs, filters for liquid crystal display devices, security printing applications, machine readable items, and printed circuits.

Transfer failure, in which imaging material fails to transfer, has been a problem in thermal transfer processes. Thus there is a need for thermal transfer processes which minimize or overcome the problem of transfer failure.

SUMMARY OF THE INVENTION

The invention relates to a method for thermally transferring an imaging material from an imaging donor to a receiver to form a pattern of the imaging material on the receiver comprising thermally transferring a transparent texturing material from a texturing donor to the receiver prior to thermally transferring the imaging material to the receiver.

BRIEF DESCRIPTION OF THE DRAWINGS

FIG. 7 is a simplified schematic diagram of a textured receiver with a transferred imaging material.

FIGS. 8*a*–8*i* are simplified schematic diagrams of color filters.

DETAILED DESCRIPTION OF THE INVENTION

Figure 1:
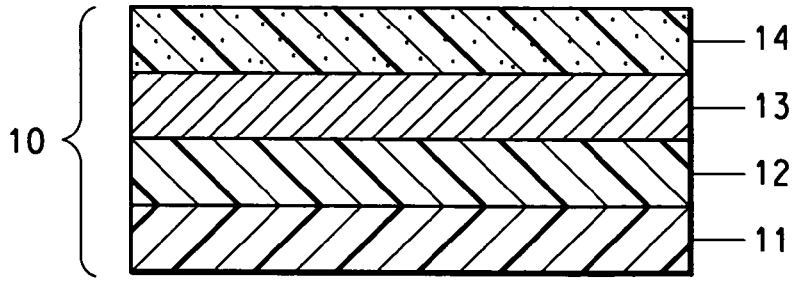
FIG. 1 is a simplified schematic diagram of a texturing donor.

The invention relates to an improved method for thermally mass transferring an imaging material from an imaging donor to a receiver to form a pattern of the imaging material on the receiver wherein the improvement comprises thermally mass transferring a transparent texturing material from a texturing donor to the receiver prior to thermally mass transferring the imaging material to the receiver.

Thermal Transfer Process

In the thermal transfer process an imaging material is transferred from an imaging donor to a receiver to form a pattern of the imaging material on the receiver. More particularly, the imaging material is transferred by laser induced thermal transfer of the imaging material to the receiver. However, any known technique for thermal transfer can be employed.

In the process of this invention, a texturing donor having a texturing material is employed in the thermal transfer process. The texturing material is transferred to the receiver prior to thermal transfer of the imaging material. The texturing material should improve the subsequent transfer of the imaging material by reducing the degree of failed transfers of the imaging material. Failured transfers result in visible defects in the appearance of the receiver after an attempted thermal transfer. The visible defects can be macroscopic or microscopic.

The texturing material should produce a texture on the receiver which texture should provide a gap between the imaging donor and the untextured areas of the receiver which areas lack texturing material. The properties of the texturing material and the pattern of its transfer are such that the gap is not so large as to impede thermal transfer of the imaging material. Imaging material can be transferred to any of the textured and untextured areas of the receiver. Transfers can occur when the imaging donor is either in contact or in proximity to any of the textured and untextured areas of the receiver. In general, a donor element is used to provide material that is thermally transferred to a receiver element. The donor has a support which is not thermally transferred to the receiver element, that serves to hold material in an appropriate alignment and distance to the receiver element during thermal transfer in an assemblage. Films are commonly used as supports, varying from 10 to 150 microns in thickness. In one embodiment, the support comprises a 25 micron thick transparent polyester film comprising polyethylene terephthalate and a blue colorant having a thin layer of chromium transmitting from 40 to 60% of photons corresponding to 832 nanometer wavelength radiation on the side which supports the imaging material. In this invention, there is a texturing donor and an imaging donor which are both described below. The texturing donor is used to transfer a texturing material. The imaging donor is used to transfer an imaging material.

One advantage of the invention is that material that is thermally transferred can be selected from a wide variety of materials. Imaging materials are typically applied to the receiver in thin layers of less than 50 microns in thickness, which places a limit on the size of the imaging material that is thermally transferred in at least one dimension of imaging material.

Texturing Donor

FIG. 1 shows a texturing donor (10) useful for thermal transfer imaging in accordance with the process of this invention. There comprises a texturing layer (14) and a support having a coatable surface that comprises an optional ejection layer (12) and optionally a heating layer (13). Each of these layers has separate and distinct functions. A support layer for the texturing donor (11) is also present. In one embodiment, the optional heating layer (13) may be present directly on the support layer (11).

Texturing Layer:

Applying a layer of a composition comprising a texturing material to a support forms the texturing layer (14). Preferred properties of the texturing layer can be understood by considering the use of the texturing layer in texturing a receiver. When portions of the applied layer are transferred to a receiver, the transferred portions provide for a separation of the imaging material and the receiver, proximate to the transferred portions, in a subsequent assemblage. In order to provide this separation, it is preferred that the transferred portions not change in thickness by flow in the subsequent assemblage. In order to carry out imaging of a subsequent assemblage in a predictable fashion, it is preferred that the transferred portions provide a predictable distance of separation.

In one embodiment, some part of the volume of the texturing layer is transferred unchanged to the receiver to form the texture, for example by ablative mass transfer or laser induced film transfer. In one embodiment, the texturing layer includes (i) a texturing material which is a binder, and optionally (ii) another texturing material such as a solid. Examples of solids include particles, typically fine particles such as pigments or fillers. The texturing layer can also include a dye, plasticizer, or other components of known utility for transferable layers of donors. Suitable texturing layers can be provided by well-known donors, such a donors used in color proofing that provide a volume of transferred material being transferred to a receiver. Texturing layers can be colored by colorants such as pigments or dyes.

The binder of the texturing layer can be a polymeric material having a decomposition temperature that is greater than about 250° C. and specifically greater than about 350° C. The binder is preferably film forming and coatable from solution or from a dispersion. Binders having melting points less than about 250° C. or plasticized to such an extent that the glass transition temperature is less than about 70° C. are typical. However, easily liquifiable and heat-fusible binders, such as low-melting waxes should be avoided as the sole binder if such binders flow and are not durable, although they are useful as cobinders in decreasing the melting point of the texturing layer.

If the binder is to be transferred along with another texturing material, it is typical that the polymer of the binder not self-oxidize, decompose or degrade at the temperature achieved during the laser exposure. By virtue of this selection, the exposed areas of the texturing layer comprising the texturing material and binder can be transferred intact for improved durability.

Examples of suitable binders include copolymers of styrene and (meth)acrylate esters, such as styrene/methylmethacrylate; copolymers of styrene and olefin monomers, such as styrene/ethylene/butylene; copolymers of styrene and acrylonitrile; fluoropolymers; copolymers of (meth) acrylate esters with ethylene and carbon monoxide; polycarbonates having appropriate decomposition temperatures; (meth)acrylate homopolymers and copolymers; polysulfones; polyurethanes; polyesters. The monomers for the above polymers can be substituted or unsubstituted. Substituents may include halogen, oxygen or nitrogen containing substituents. Mixtures of polymers can also be used.

Specific polymers for the binder include, but are not limited to, acrylate homopolymers and copolymers, methacrylate homopolymers and copolymers, (meth)acrylate block copolymers, and (meth)acrylate copolymers containing other comonomer types, such as styrene.

Other specific polymers for the binder include, but are not limited to, random copolymers of comonomers chosen from methyl methacrylate, n-butyl methacrylate, glycidyl methacrylate, n-butyl acrylate, methacrylic acid, acrylic acid, styrene, and macromonomers. Chain transfer agents such as macromonomers can control the molecular weight of the specific polymers.

The polymer of the binder generally can be used in a concentration of about 15 to about 100% by weight, based on the total weight of the texturing layer, specifically about 30 to about 40% by weight.

When an optional texturing material that is a solid is used, a binder is a preferred material to hold the solid in the texturing layer. A preferred solid is a pigment chosen from "The National Printing and Ink Research Institute (NPIRI) Raw Materials Data Handbook", Volume 4, Second Edition, 2000, available from the National Association of Printing Ink Manufacturers, Inc, of Woodbridge, N.J. Suitable pigments include inorganic and organic pigments including iron oxides of various colors, zinc oxide, carbon black, titanium dioxide, graphite, phthalocyanines and metal phthalocyanines (e.g., copper phthalocyanine), quinacridones, epindolidiones, perylenes, azo pigments, indanthrone blues, carbazoles (e.g. carbazole violet), isoindolinones, isoindolones, thioindigo reds, benzimilazolinones, Rubine F6B (C.I. No. Pigment 184), Cromophthal.RTM. Yellow 3G (C.I. No. Pigment Yellow 93), Hostaperm.RTM. Yellow 3G (C.I. No. Pigment Yellow 154), Monastral.RTM. Violet R (C.I. No. Pigment Violet 19), 2,9-dimethylquinacridone (C.I. No. Pigment Red 122), Indofast.RTM. Brilliant Scarlet R6300 (C.I. No. Pigment Red 123); Quindo Magenta RV 6803; Monstral.RTM. Blue G (C.I. No. Pigment Blue 15), and Monstral.RTM. Blue G BT 284D (C.I. No. Pigment Blue 15). Another preferred solid is a filler such as one of talc, china clay, barytes, carbonates, glass beads, calcined kaolin, aluminium hydroxide, silicates, and a finely-divided organic powder of, e.g., a urea-formaldehyde resin, a styrene/methacrylic acid copolymer or polystyrene. Combinations of solids can be used as texturing material. Combinations of binders can also be used.

Properties required of the transferred texturing material might need to be considered in choosing a suitable texturing material. For example, for a color filter, the transparency and color of the texturing material should be considered to permit light to be passed through the transferred texturing material. Transparent texturing materials must allow sufficient light to pass through. A colored pigment may be transparent allowing light to pass through without scattering. In one embodiment the texturing material is colorless and transparent such that visible light can pass through without color change and without scattering. An insubstantial amount of either color change or light scattering may happen so long as the color change or scattering does not have a detrimental effect on the collimation or color of the visible light. Alternatively, for a color filter, if the transferred texturing material is patterned onto regions of the color filter where light does not pass, the transparency and color of the transferred texturing material need not be considered. In such a case, the texturing material may be translucent, opaque, scattering, transparent, colored, or uncolored.

The texturing layer may be transparent, translucent, or opaque. The texturing layer can be colorless, colored, white, gray, or black. Dyes which absorb infrared radiation can be included in the texturing layer. Examples of suitable near infrared (NIR) absorbing dyes, which can be used alone or in combination, include, but are not limited to, poly(substituted) phthalocyanine compounds and metal-containing phthalocyanine compounds; cyanine dyes; squarylium dyes; chalcogenopyryioacrylidene dyes; croconium dyes; metal thiolate dyes; bis(chalcogenopyrylo) polymethine dyes; oxyindolizine dyes; bis(aminoaryl) polymethine dyes; merocyanine dyes; and quinoid dyes. Numerous dyes absorbing visible light may also be utilized with the present invention which are well known in the art, that include, but are not limited to, anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM®, and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Greene® (product of Hodogaya Chemical Co., Ltd.); or any of the dyes disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. The dyes and pigments of the present invention may be employed singly or in combination.

For color printing applications including the manufacture of color filters the texturing material can be transparent and colorless so that it will not interfere with color attributed to the imaging material. Examples of texturing material for electronic applications include, without limit, conductors, semiconductors, and insulators.

For other applications such as the formation of electronic circuits the texturing material need not be transparent but care must be taken that it does not interfere with the electronic properties of the imaging material.

A dispersion of the texturing material can be prepared to form a thermally texturing layer of the texturing donor. Such a dispersion can be prepared by dispersing the appropriate texturing material using one or more polymeric dispersants in aqueous or organic media. Color filters for liquid crystal display applications require very high transparency of the texturing material transferred to active filtering areas, and if the binder of the texturing layer is transferred along with the texturing material transparency of the binder is also important.

A dispersant is usually used in combination with the texturing material when applied in a dispersion to the support in order to achieve maximum color strength, transparency and gloss. The dispersant is generally an organic polymeric compound and is used to separate the fine texturing material and avoid flocculation and agglomeration of particles when a particulate texturing material is employed. A wide range of dispersants is commercially available. A dispersant will be selected according to the characteristics of the surface of the texturing material and other components in the composition as known by those skilled in the art. However, one class of dispersant suitable for practicing the invention is that of the AB dispersants. The A segment of the dispersant adsorbs onto the surface of the texturing material. The B segment extends into the solvent into which the texturing material is dispersed. The B segment provides a barrier between texturing material particles to counteract the attractive forces of the particles, and thus to prevent agglomeration. The B segment should have good compatibility with the solvent used. The AB dispersants of utility are generally described in U.S. Pat. No. 5,085,698. Conventional particle dispersing techniques, such as ball milling, sand milling, etc., can be employed.

A specific dispersant useful in this invention is a block copolymer made by group transfer polymerization from benzyl methacrylate and trimethylsilyl methacrylate wherein some or all of the polymerized trimethylsilyl methacrylate is hydrolyzed to produce polymerized methacrylic acid groups.

The texturing material is typically present in an amount of from about 5 to 100% by weight, typically about 90 to about 100% by weight, based on the total weight of the composition of the texturing layer.

Thermal Amplification Additive

In one embodiment, a thermal amplification additive is present in the texturing layer, but may also be present in the ejection layer(s) or heating layer(s).

The function of the thermal amplification additive is to amplify the effect of the heat generated in the heating layer and thus to further increase sensitivity to the laser. This additive should be stable at room temperature. The additive can be (1) a decomposing compound which decomposes when heated, to form gaseous by-products(s), (2) an absorbing dye which absorbs the incident laser radiation, or (3) a compound which undergoes a thermally induced unimolecular rearrangement which is exothermic. Combinations of these types of additives may also be used.

Decomposing compounds of group (1) include those which decompose to form nitrogen, such as diazo alkyls, diazonium salts, and azido (—$N_3$) compounds; ammonium salts; oxides which decompose to form oxygen; carbonates or peroxides. Specific examples of such compounds are diazo compounds such as 4-diazo-N,N'-diethyl-aniline fluoroborate (DAFB). Mixtures of any of the foregoing compounds can also be used.

An absorbing dye of group (2) is typically one that absorbs in the infrared region. Examples of suitable near infrared absorbing (NIR) dyes which can be used alone or in combination include poly(substituted) phthalocyanine compounds and metal-containing phthalocyanine compounds; cyanine dyes; squarylium dyes; chalcogenopyryioacrylidene dyes; croconium dyes; metal thiolate dyes; bis(chalcogenopyrylo) polymethine dyes; oxyindolizine dyes; bis(aminoaryl) polymethine dyes; merocyanine dyes; and quinoid dyes. When the absorbing dye is incorporated in the ejection layer, its function is to absorb the incident radiation and convert this into heat, leading to more efficient heating. It is typical that the dye absorbs in the infrared region. It is often the case that the dye has very low absorption in the visible region.

Absorbing dyes of group (2) include the infrared absorbing materials which are well known. Examples are disclosed in U.S. Pat. Nos. 4,778,128; 4,942,141; 4,948,778; 4,950,639; 5,019,549; 4,948,776; 4,948,777 and 4,952,552.

When present in the texturing layer, the thermal amplification additive can be used in a weight percentage generally at a level of about 0.95-about 11.5%. The percentage can range up to about 25% of the total weight percentage in the texturing layer. These percentages are non-limiting and one skilled in the art can vary them depending upon the particular composition of the layer.

The thermally texturing layer generally has a thickness in the range of about 0.1 to about 5 micrometers, typically in the range of about 0.1 to about 1.5 micrometers. A hickness greater than about 5 micrometers is generally not useful as it might require excessive energy in order to be effectively transferred to the receiver.

Support

Typically, there is a support for the texturing layer which comprises a support layer (11) which support layer can be any film that has sufficient transparency at the illumination wavelength and sufficient mechanical stability for use in the laser induced thermal transfer process. Typically the support layer comprises a coextruded polyethylene terephthalate film. A useful thickness for the support layer when it is a coextruded polyethylene terephthalate film is 400 gauge. Alternatively, the support layer may be polyester film, specifically polyethylene terephthalate that has been plasma treated to accept the heating layer such as the MELINEX® line of polyester films made by DuPont Teijin Films™ a joint venture of DuPont and Teijin Limited. The support may also comprise an anchoring layer to improve the adhesion of other layers. When the support layer is plasma treated, an ejection layer is usually not provided. Backing layers may optionally be provided on the support layer. These backing layers may contain fillers to provide a roughened surface on the back side of the support layer, i.e. the side of the support layer opposite from the texturing layer. Alternatively, the support layer itself may contain fillers, such as silica, to provide a roughened surface on the back surface of the support layer. Alternately, the support layer may be physically roughened to provide a roughened surface on one or both surfaces of the support layer said roughening being sufficient to scatter the light emitted from a non-imaging laser or a focussing laser. Some examples of physical roughening methods include sandblasting, impacting with a metal brush, etc.

If the support comprises an additional support layer, typically to enhance mechanical stability, the support may be made up of multiple layers of different materials. Typically, the support layer is a thick polyethylene terephthalate film.

Metallized polyester films can be used as the support layer. Specific examples include single or multilayer polyester films such as polyethylene terephthalate or polyolefin films. The support layer usually ranges in thickness from about 1 to 4 mils. Useful polyethylene terephthalate films include MELINEX® 473 (4 mil thickness), MELINEX® 6442 (4 mil thickness), MELINEX® LJX 111 (1 mil thickness), and MELINEX® 453 (2 mil thickness), all metallized to 50% visible light transmission with metallic chromium by CP Films, Martinsville, Va.

Ejection Layer

The optional ejection layer (12), which is usually flexible, which may be on one side of the support layer (11), as shown in FIG. 1, can be utilized to provide force to effect transfer of the texturing layer to the receiver element in the exposed areas. When heated, the ejection layer decomposes into gaseous molecules providing the necessary pressure to propel or eject the exposed areas of the texturing layer onto the receiver element. This is accomplished by using a polymer having a relatively low decomposition temperature (less than about 350° C., typically less than about 325° C., and more typically less than about 280° C.). In the case of polymers having more than one decomposition temperature, the first decomposition temperature should be lower than 350° C. Furthermore, in order for the ejection layer to have suitably high flexibility and conformability, it should have a tensile modulus that is less than or equal to about 2.5 Gigapascals (GPa), specifically less than about 1.5 GPa, and more specifically less than about 1 Gigapascal (GPa). The polymer chosen should also be one that is dimensionally stable. If the thermal transfer occurs by transmitting laser radiation through the ejection layer, the ejection layer should be capable of transmitting the laser radiation, and not be adversely affected by this radiation.

Examples of suitable polymers for the ejection layer include (a) polycarbonates having low decomposition temperatures (Td), such as polypropylene carbonate; (b) substituted styrene polymers having low decomposition temperatures, such as poly(alpha-methylstyrene); (c) polyacrylate and polymethacrylate esters, such as polymethylmethacrylate and polybutylmethacrylate; (d) cellulosic materials having low decomposition temperatures (Td), such as cellulose acetate butyrate and nitrocellulose; and (e) other polymers such as polyvinyl chloride; poly(chlorovinyl chloride) polyacetals; polyvinylidene chloride; polyurethanes with low Td; polyesters; polyorthoesters; acrylonitrile and substituted acrylonitrile polymers; maleic acid resins; and copolymers of the above. Mixtures of polymers can also be used. Additional examples of polymers having low decomposition temperatures can be found in U.S. Pat. No. 5,156,938. These include polymers which undergo acid-catalyzed decomposition. For these polymers, it is frequently desirable to include one or more hydrogen donors with the polymer.

Specific examples of polymers for the ejection layer are polyacrylate and polymethacrylate esters, low Td polycarbonates, nitrocellulose, poly(vinyl chloride) (PVC), and chlorinated poly(vinyl chloride) (CPVC). Most specifically are poly(vinyl chloride) and chlorinated poly(vinyl chloride).

Other materials can be present as additives in the ejection layer and other layers as long as they do not interfere with the essential function of the layer. Examples of such additives include coating aids, flow additives, slip agents, antihalation agents, plasticizers, antistatic agents, surfactants, and others which are known to be used in the formulation of coatings.

Heating Layer

The optional heating layer (13), as shown in FIG. 1, is deposited on the support onto any ejection layer that may be present. The function of the heating layer is to absorb the laser radiation and convert the radiation into heat. Materials suitable for the heating layer can be inorganic or organic and can inherently absorb the laser radiation or include additional laser-radiation absorbing compounds.

Examples of suitable inorganic materials are transition metal elements and metallic elements of Groups IIIA, IVA, VA, VIA, VIIIA, IIB, IIIB, and VB of the Period Table of the Elements (Sargent-Welch Scientific Company (1979)), their alloys with each other, and their alloys with the elements of Groups IA and IIA. Tungsten (W) is an example of a Group VIA metal that is suitable and which can be utilized. Carbon (a Group IVB nonmetallic element) can also be used. Specific metals include Al, Cr, Sb, Ti, Bi, Zr, Ni, In, Zn, and their alloys and oxides. $TiO_2$ may be employed as the heating layer material.

The thickness of the heating layer is generally about 10 Angstroms to about 0.1 micrometer, more specifically about 20 to about 60 Angstroms.

Although it is typical to have a single heating layer, it is also possible to have more than one heating layer, and the different layers can have the same or different compositions, as long as they all function to covert laser radiation to heat. The total thickness of all the heating layers should be in the range given above.

The heating layer(s) can be applied using any of the well-known techniques for providing thin metal layers, such as sputtering, chemical vapor deposition, and electron beam.

Additional Layers:

The texturing donor may comprise additional layers. For example, an antihalation layer may be used on the side of the ejection layer, preferably when the ejection layer is flexible, opposite the texturing layer. Materials, which can be used as antihalation agents, are well known in the art. Also anchoring layers can be present on either side of the ejection layer and are also well known in the art.

In some embodiments of this invention, a material functioning as a heat absorber and an imaging material is present in a single layer, termed the top layer. Thus the top layer has a dual function of being both a heating layer and a texturing layer. The characteristics of the top layer are the same as those given for the texturing layer. A typical material functioning as a heat absorber is carbon black.

Imaging Donor

Figure 2:
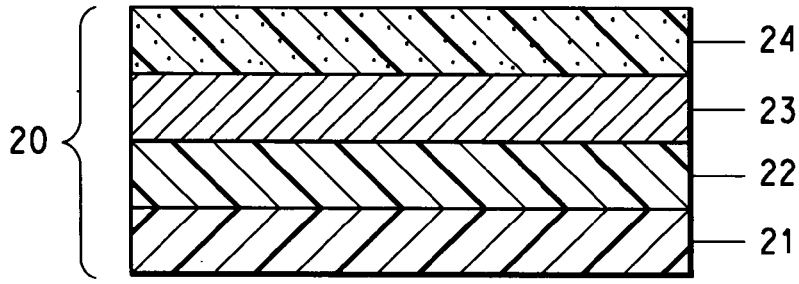
FIG. 2 is a simplified schematic diagram of an imaging donor.

FIG. 2 shows an imaging donor (20). There comprises an imaging layer (24) and a support for the imaging layer that has a coatable surface which comprises an optional ejection layer (22) and optionally a heating layer (23). Each of these layers has separate and distinct functions. A support layer for the imaging donor (21) is also present. In one embodiment, the optional heating layer (23) may be present directly on the support (21).

Imaging Layer

As well known in the art of laser induced imaging, the imaging layer (24) is formed by applying a layer of an imaging composition to a support. The imaging layer comprises (i) a binder which is usually different from the polymer used in the optional ejection layer, and (ii) an imaging material.

The same types of materials that are suitable as the binder of the texturing layer would also be suitable as the binder of the imaging layer.

The polymer of the binder generally can be used in a concentration of about 15 to about 50% by weight, based on the total weight of the colorant-containing layer, specifically about 30 to about 40% by weight.

Because the texturing donor improves thermal transfer of an imaging material, a wide variety of imaging materials are contemplated even those that would have been considered to have high transfer failure in laser induced thermal transfer processes. Suitable imaging materials include, without limit solids and liquids which may be organic or inorganic or a composite, such as an organometallic, or a combination such as a mixture of organic and metallic compositions. Suitable solids include films and particles. The particles may be regular or irregular in shape and may be smooth or rough and may be colorants, opaque or transparent. Typically the particles are in the form of beads or spheres. Suitable imaging materials include, without limit, paper, glass, metals, dyes, pigments, crystals, polymers, waxes, conductors, insulators, semiconductors. Imaging materials that are liquids include, without limit, reagents, solvents, and plasticizers. Mixtures of any of the foregoing may also be useful. Imaging materials may include without limit one or more of electrically or optically active materials chosen from colorants, conductors, semiconductors, insulators, charge transport materials, electron transport materials, electroluminescent compounds, photochromic compounds, pigments, phosphorescent materials, and dyes; and chemically active materials such as enzymes, antibodies and reagants. When the imaging material is a colorant it is typically an organic or inorganic pigment. Examples of suitable inorganic pigments include titanium dioxide, carbon black and graphite. Examples of suitable organic pigments include color pigments such as Rubine F6B (C.I. No. Pigment 184); Cromophthal® Yellow 3G (C.I. No. Pigment Yellow 93); Hostaperm® Yellow 3G (C.I. No. Pigment Yellow 154); Monastral® Violet R (C.I. No. Pigment Violet 19); 2,9-dimethylquinacridone (C.I. No. Pigment Red 122); Indofast® Brilliant Scarlet R6300 (C.I. No. Pigment Red 123); Quindo Magenta RV 6803; Monastral® Blue G (C.I. No. Pigment Blue 15); Monastral® Blue BT 383D (C.I. No. Pigment Blue 15); Monastral® Blue G BT 284D (C.I. No. Pigment Blue 15); and Monastral® Green GT 751D (C.I. No. Pigment Green 7). Combinations of pigments and/or dyes can also be used. For color filter array applications, high transparency pigments (that is at least about 80% of light transmits through the pigment) are typical, having small particle size (that is about 100 nanometers).

Dispersions for preparation of the imaging layer can be prepared by dispersing the appropriate imaging material such as pigment using one or more polymeric dispersants in aqueous media. Suitable imaging material dispersions can be prepared by known techniques.

In one embodiment, the imaging material is a blend of materials comprising acrylic-styrenic copolymer, and an infrared-absorbing dye sufficient to absorb between 10% and 90% of photons corresponding to 832 nanometer wavelength radiation, and well dispersed transparent pigment. The blend is in a 0.3 to 2.5 micron thick layer of imaging layer on the support.

While imaging material is transferred in the process the binder and any other components of the imaging layer may also be transferred.

In general, the scope of the invention is intended to include any application in which material is to be applied to a receptor in a pattern, for example by a method such as dye diffusion, ablation mass transfer, or laser induced thermal transfer. An example of a specific application is the construction of electronic circuitry, wherein the material transferred affects circuit characteristics. In electronic circuit applications, the imaging material is an electrically conductive material, semiconductor, or precursor to these functions. Specific examples of imaging materials for this application include, without limit, graphite, silver, aluminum, copper and the like.

The imaging layer can be obtained by coating the ingredients from which the imaging layer is formed onto the support by techniques that are well known in the art.

Receiver Element

Figure 3:
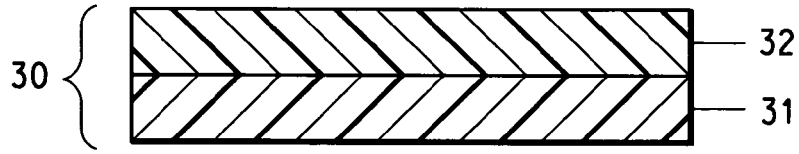
FIG. 3 is a simplified schematic diagram of a receiver element.

The receiver element (30), shown in FIG. 3, is the part of the laserable assemblage, to which the exposed areas of the texturing material and the imaging material can be transferred. Transferring the texturing material and subsequently transferring the imaging material to the receiver element can be a final step in the process or an intermediate step, for example in which the receiver element is a temporary carrier that transfers the imaging material to the permanent substrate.

The receiver element (30) may be non-photosensitive or photosensitive.

The non-photosensitive receiver element usually comprises a receiver support (31) and a receiving layer (32) having an outer surface. The receiving layer and the support may be a multilayer structure of a different composition or it may be a single layer structure (not shown). The receiver support (31) usually comprises a dimensionally stable sheet material that can be the same or different from that used for the support of the imaging donor.

Examples of receiver supports include, for example films of polyethylene terephthalate, polyether sulfone, a polyimide, a poly(vinyl alcohol-co-acetal), polyethylene, or a cellulose ester, such as cellulose acetate. The assemblage can be imaged through the receiver support if that support is sufficiently transparent. The support can also be opaque. Examples of opaque supports include, for example, films of polyethylene terephthalate filled with a white pigment such as titanium dioxide, ivory paper, or synthetic paper, such as Tyvek® spunbonded polyolefin made by E.I. du Pont de Nemours and Company of Wilmington, Del. Paper supports are typical for proofing applications, while a polyester support, such as poly(ethylene terephthalate) is typical for a medical hardcopy and color filter array applications. Roughened supports may also be used in the receiver element. The receiver support may be multilayered such as a polyester film with a polyacetate coating for example an ethylene vinyl acetate copolymer. The receiver element can comprise glass. In one embodiment of a color filter the receiver element is glass with a photolithographically or thermal transfer produced mask. In another embodiment, the mask is applied after at least one imaging material is transferred. A specific embodiment of a receiver element is an imagereceiving layer on a photolithographically produced mask on a glass sheet. In this embodiment, the photolithographically produced mask on a glass sheet is also a permanent substrate. The image receiving layer can be placed on a receiver support such as glass or glass with a photolithographically produced mask by methods such as lamination, coating, spin coating, or spraying.

The image receiving layer or layers described above may optionally include one or more other layers between the receiver support and the image receiving layer. A useful additional layer between the image receiving layer and the support is a release layer. The release layer can provide the desired adhesion balance to the receiver support so that the image-receiving layer adheres to the receiver support during exposure and separation from the imaging donor, but promotes the separation of the image receiving layer from the receiver support in subsequent steps. Examples of materials suitable for use as the release layer include polyamides, silicones, vinyl chloride polymers and copolymers, vinyl acetate polymers and copolymers and plasticized polyvinyl alcohols. The release layer can have a thickness in the range of about 1 to about 50 microns.

A receiver element has at least one surface that receives texturing material and optionally imaging material, hereafter termed a receiving surface. A receiving surface can be regular or irregular, and of any shape. In one embodiment, the receiver element has a receiving surface that is regular, smooth, and flat. In another embodiment, the receiver element has a receiving surface that is regular, smooth, and concave. In another embodiment, the receiver element has a receiving surface that is regular, smooth and convex. In another embodiment, the receiver element has a receiving surface that is regular and wavy. In another embodiment, the receiver element has a receiving surface that is irregular and wavy. In another embodiment, the receiver element has a receiving surface that is irregular and rough. A receiver may have a plurality of receiving surfaces, with related or independent surface shapes and surface regularity.

In the case of a color filter as known in the art, the receiver element may be a transparent or selectively transparent substrate such as a sheet of glass, or a sheet of glass having a black mask. In one embodiment, the sheet of glass has a receiving surface that is regular and flat.

Every finite surface has a minimum equivalent surface area, equal to the surface area which could be measured if the surface were flattened to a smooth regular surface of average height (thus eliminating surface area contributed by roughness and waviness). Unless otherwise specified or apparent from the context, all discussions herein of surface area refer to the minimum equivalent surface area.

Two finite surfaces brought into contact over a surface area define an interface with an interfacial area. Every interfacial area has an equivalent minimum interfacial area, equal to the equal minimal equivalent surface areas of the surfaces in contact.

Imaging Process Steps

This invention converts a receiver element that is prone to failures to accept transfer of imaging material in an intended pattern, into a textured receiver element. The textured receiver element is robust in accepting transfers of imaging materials in a pattern, thereby reducing transfer failure as compared to receiver elements that are not texturized in accordance with this invention.

The process of this invention provides a textured receiver element. In a subsequent assemblage, the texturing material of the textured receiver element serves to hold portions of the subsequent donor element at a short distance from the untextured surface of the receiver element, therefore the texturing material maintains a short distance of separation between the donor and receiver in a subsequent assemblage. Typically, the short distance of separation is no more than the distance over which a thermal transfer can occur across a gap such as an air gap, so that a subsequent thermal imaging step can operate successfully when close to an area having texturing material. In one embodiment, the texturing material is used to produce a texturing of about 0.3 to about 15 microns in height over portions of the receiving surface of the receiver element. In one embodiment, donor elements operating by an ablation mass transfer mechanism to transfer a layer of material between about 0.3 and about 15 microns in thickness are used. In another embodiment, donor elements operating by a laser-induced film transfer mechanism to transfer a layer of material between about 0.3 and about 15 microns in thickness are used.

Figure 4:
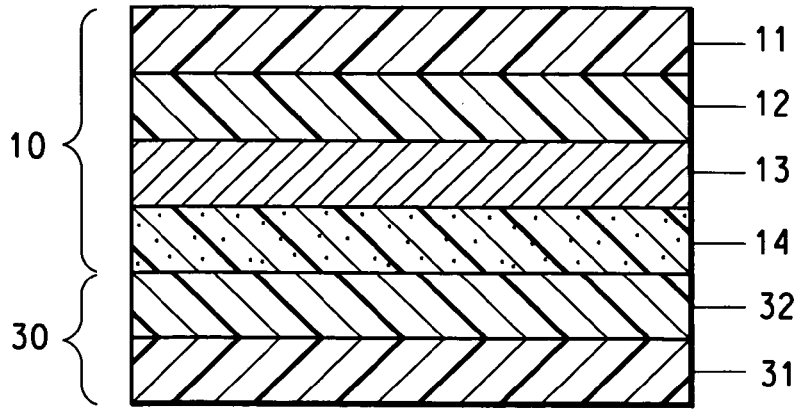
FIG. 4 is a simplified schematic diagram of an assemblage of this invention formed by a texturing donor and a receiver.

FIG. 4 shows a first laserable assemblage of the texturing donor and the receiver. The texturing layer (14) is next to the outer surface of the image receiving layer of the receiver element (30). Typically, the receiver element is placed on a vacuum table and the texturing donor is positioned to completely cover the receiver element. Typically the texturing layer and the outer surface of the image receiving layer are in contact. The vacuum table draws air from between the donor element and the receiver element until contact is made between the outer surface of the receiver element and the texturing layer of the texturing donor. A roller can be used to push trapped air bubbles away to the outer edges of the first laserable assemblage. As one alternative, the first laserable assemblage is held together by fusion at the periphery. As another alternative, the first laserable assemblage is held together by taping the texturing donor and receiver element together and the first laserable assemblage is then taped to the imaging apparatus, or a pin/clamping system can be used. As yet another alternative, the texturing donor is laminated to the receiver element to form a first laserable assemblage. The first laserable assemblage can be conveniently mounted on a drum to facilitate laser imaging. Those skilled in the art will recognize that other engine architectures such as flatbed, internal drum, capstan drive, etc. can also be used with this invention.

Imaging radiation at an appropriate wavelength is directed into the first laserable assemblage and exposed to the laser radiation. The assemblage is imagewise exposed to photons as one step of thermal imaging. The photons used in the exposure step are equivalent to radiant energy of a specific wavelength, and carry energy. In one embodiment, photons equivalent to a radiant energy in the infrared region including from 700 to 10,000 nanometers in wavelength are used. In another embodiment, photons equivalent to a radiant energy in the infrared region including from 820 to 840 nanometers in wavelength are used. In another embodiment, photons equivalent to a radiant energy in the visible region including from 400 to 700 nanometers in wavelength are used. In another embodiment, photons equivalent to a radiant energy in the ultraviolet region including from 200 to 400 nanometers in wavelength are used. The photons can be supplied by a laser. The exposure step can be effected at an energy fluence of about 700 $mJ/cm^2$ or less, or about 2 to 440 $mJ/cm^2$, or about 10, 50, 100, 200, 300, 400, 500 or 650 $mJ/cm^2$. Exposure time can be chosen as convenient. In one embodiment, an exposure time as short as 3 microseconds is used.

The pattern of photon exposure is preferably realized at high resolution by a focused source of photons capable of addressing a small area or a small volume of the assemblage at one time. In one embodiment, a resolution of about 1 to 5 microns in feature size is achieved. In one embodiment, a plurality of laser beams is combined to provide a concentrated focused source of photons having a desirable distribution of energy within the area illuminated (e.g., uniformly distributed or less energy in a central area). In one embodiment, the source of photons is a laser head having 100 to 1000 individually addressable beams each having a largest dimension of 20 microns in length and 3 microns in width, combined into a rectangle of 2 to 20 centimeters in length and 3 microns in width.

The location of a small area of the assemblage exposed to a high resolution source of photons may be changed rapidly by physical movement of the assemblage or photon beam. The location of a small area of the assemblage exposed to the high resolution source of photons may be changed rapidly by optical movement of the photon beam. The high resolution source of photons impinging on a small area can be rapidly started or stopped to create the desired pattern of exposure. In one embodiment, physical movement of the assemblage is accomplished at 2 meters per second to an accuracy of 1 micron in displacement using a precision-aligned stage. In one embodiment, the source of photons can by cycled on and off in a period of 3 microseconds. In one embodiment, the source of photons is dithered over the small area of square measuring 10 microns on each side.

The pattern of exposure accomplished by the source of photons impinging on the assemblage can be simple or complex. Small dots can be patterned, as in printing or proofing of images by half tone imaging. Shapes can be patterned, as in printing geometric Figures such as various similar or dissimilar squares, rectangles, triangles, circles, mazes, or polygons, or various symbols such as the symbols in an alphabet. One application of similar rectangles, squares, or stripes that can be patterned is as in a color filter. Other complex patterns such as electrical circuit patterns and grids for diagnostic testing dependent on the location of reagents can be realized.

The exposure may take place through the optional ejection layer and/or the heating layer of the texturing donor by conventional methods.

The first laserable assemblage is exposed imagewise so that the exposed areas of the texturing material are transferred to the receiving layer of the receiver element in a pattern. Any pattern can be a texturable pattern if it is realized on a receiver as a texture. A texture is recognized by a technique such as profilometry that can detect a change in topography of a receiver due to texturing. A texture on a receiver will prevent a transferable surface of a donor element from contacting the original receiving surface of the receiver in the area of the textured material and in an adjacent area. Instead, the transferable surface of a donor will contact the textured material and be suspended above the original receiving surface of the receiving element in the area of the texturing material.

The next step in the process of the invention is separating the texturing donor support from the receiver element 30. Usually this is done by simply peeling the two elements apart. This generally requires very little peel force, and is accomplished by simply separating the support layer of the texturing donor from the receiver element. This can be done using any conventional separation technique and can be manual or automatic without operator intervention.

Generally if one or more of an ejection layer and heating layer are used they are removed together with the support layer.

A specific method of separating the texturing donor support from the receiver element is by peeling the texturing donor support away from the nearly immobile receiver element. Peeling can be done manually, or by manipulating the texturing donor over a guide. A specific guide that can be used is a rod. Any direction of peeling can be used.

Figure 5:
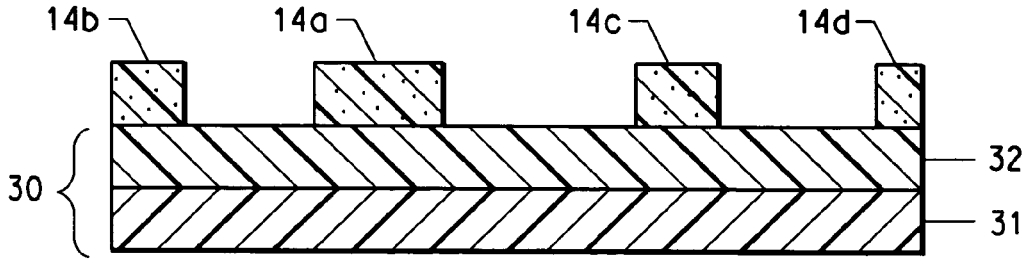
FIG. 5 is a simplified schematic diagram of a textured receiver of this invention.

Separation results in a textured receiver element having a texturing material thereon which forms a textured surface as shown in FIG. 5. The removed donor support carries with it any texturing material that was not transferred to the receiver element. Typically multiple areas of texturing material remain on the textured receiver element, as shown by (14*a*) to (14*d*) of FIG. 5.

The purpose of texturing a receiver that distinguishes the inventive process from other transfer processes can be understood by examining the utility of a textured receiver in a subsequent assemblage for transfer of an imaging material. A subsequent assemblage is constructed by bringing together the textured receiver and an imaging donor in the well known manner that untextured receivers are assembled with imaging donors. This is done in the alignment which contacts the texturing material with the imaging layer. The presence of the texturing material suspends the transferable material away from the original, untextured receiver, as shown in FIG. 6.

Figure 6A:
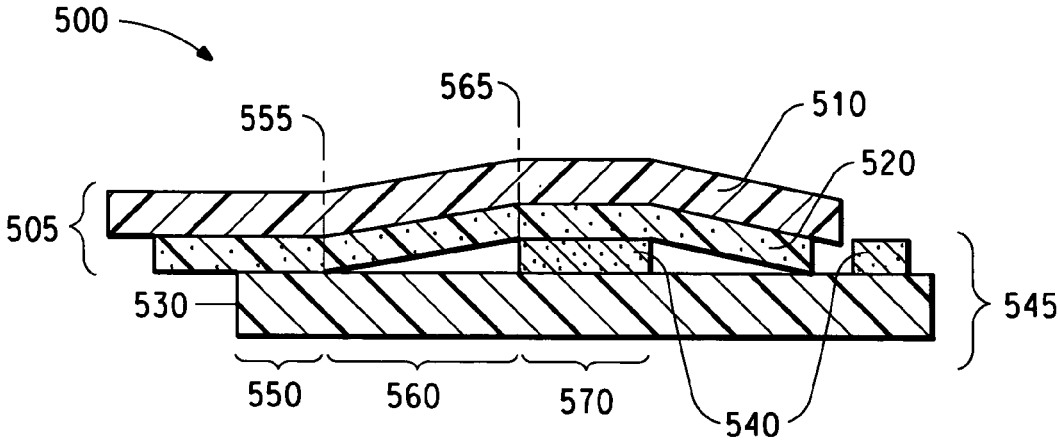
FIGS. 6*a* and 6*b* are simplified schematic diagrams of assemblages of this invention formed by a textured receiver and an imaging donor.
Figure 6B:
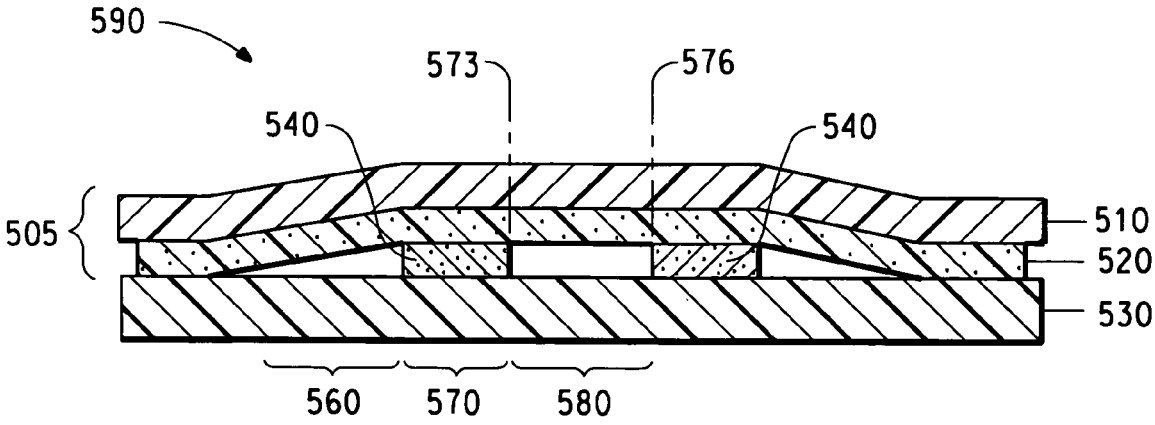

At least two modes of suspension of the imaging material of the donor element above the untextured receiving surface of a textured receiver can be distinguished, as in FIGS. 6*a* and 6*b*. FIG. 6*a* shows a form of suspension termed "draped suspension". FIG. 6*b* shows both a form of suspension termed "bridging suspension" and "draped suspension".

In FIG. 6*a*, an assemblage (500) is formed from the two elements of firstly an imaging donor (505) comprising a support layer (510) and imaging layer (520) and secondly a textured receiver (545) comprising a receiver element (530) and a transferred texturing material (540) in two locations on the upper surface of the receiver. A donor receiver interface (550) is formed by contact of the imaging material with the receiver. A donor texture interface (570) is formed by contact of the imaging material and the texturing material. A region of draped suspension (560) is formed where a separation remains between the imaging material and both of the receiver and the texturing material.

In draped suspension, a two dimensional curve or one dimensional line drawn along the donor element surface between two specific points does not pass through any interface. The first specific point (565) is at the boundary between a donor element surface and a donor element-texturing material interface. The second specific point (555) is at the boundary between a donor element surface and a donor element-untextured receiver element interface.

FIG. 6*b* shows additionally a form of bridging suspension. In FIG. 6*b*, an assemblage (590) is formed from the two elements of firstly an imaging donor (505) comprising a support layer (510) and imaging layer (520) and secondly a textured receiver comprising a receiver (530) and a transferred texturing material (540) in two locations on the upper surface of the receiver. A donor receiver interface is formed by contact of the imaging material with the receiver. A donor texture interface (570) is formed by contact of the imaging material and the texturing material. A region of draped suspension (560) is formed where a separation remains between the imaging material and both of the receiver and the texturing material. A region of bridging suspension (580) is formed between two (or more) areas of texturing material where a separation remains between the imaging material and both of the receiver and the texturing material.

In bridging suspension, a two dimensional curve or one dimensional line drawn along the donor surface between two specific points does not pass through any interface. Both specific donor texturing points (573, 576) are at the boundary between a donor element surface and a donor element-texturing material interface, and the two respective donor element-texturing material interfaces are the same or different. A receiver element is properly patterned by a texturing material ("textured") in a thermal transfer process when a subsequent thermal transfer step can be carried out in an area of the assemblage having at least one of draped suspension and bridging suspension.

Thus, the subsequent thermal imaging steps are tolerant of partial failure of the texturing step. Texturing of a receiver element typically occurs with some failures to transfer the texturing material, and typically improves the success of subsequent thermal transfer steps in comparison to the success rate which would have been found if the subsequent thermal transfer had been done on the untextured receiver element. No other property than the ability to suspend the donor element away from the receiver surface must be found in the texturing material, although other functionality may be present.

A distinguishing feature between a texturing and a non-texturing thermal transfer of imaging material is that a texturing thermal transfer is tolerant of a failure to accomplish thermal transfer. In the case of even many failures of thermal transfer of a texturing material, subsequent thermal transfer steps of imaging material can successfully convert a textured receiver into a useful object.

An assemblage is required to have at least one interface between the receiver element and the donor element; an assemblage may contain a plurality of independent, separated interfaces that may be a large number of interfaces.

In the assemblage it is not necessary that the receiver element and the donor element be in contact over all areas of an assemblage where material transfer is anticipated to occur by thermal transfer. However, the elements must be in contact or proximate. Because the distances involved for being in proximity are so small typically it is impractical to align the receiver element and the donor element with no contact whatsoever.

In the next step of the process the imaging material is thermally transferred from the imaging donor to the textured receiver. The assemblage is exposed in a pattern to laser radiation and subsequently processed by removing the support 510 and any heating and/or ejection layers as described above to transfer the imaging material to the textured receiver to generate an object as shown in FIG. 7.

In FIG. 7, transferred imaging material is shown as (24*a*,) (24*b*), and (24*c*). For (24*a*), imaging material was transferred onto texturing material (14*a*). For (24*b*), imaging material was transferred onto original receiving layer (32). For (24*c*), imaging material was transferred onto original receiving layer (32) and a portion of texturing material at (14*c*). In some cases such as (14*b*) and (14*d*), texturing material is not in contact with imaging material.

The object may be an image, such as a color image, typically a halftone dot image, comprising the transferred exposed areas of the imaging material.

The pattern employed for thermal transfer can be, for example, in the form of dots or lines generated by a computer. The pattern can be an electronic circuit pattern. The pattern can be in a form obtained by scanning artwork to be copied, in the form of a digitized image taken form original artwork, or a combination of any of these forms which can be electronically combined on a computer prior to laser exposure. The laser beam and the laserable assemblage can be in constant motion with respect to each other such that the laser individually addresses each minute area of the assemblage, i.e., "pixel". This is generally accomplished by mounting the laserable assemblage on a rotatable drum. A flat bed recorder can also be used.

According to this invention, a textured surface can accept imaging material in a subsequent thermal transfer step. In one embodiment, a textured surface in contact with an imaging donor accepts imaging material. In another embodiment, a textured surface at a transferable distance from the surface of an imaging donor element accepts imaging material. In another embodiment, an untextured surface at a transferable distance from the surface of an imaging donor element accepts imaging material. In another embodiment, a textured surface in contact with an imaging donor element accepts imaging material.

Additional Steps:

When the so revealed image is applied directly to the permanent substrate functioning as the receiver there may be no further steps of transferring the imageable material. Alternatively, the so revealed image may be applied directly to a temporary substrate, and the image may then be transferred to a permanent substrate as is known in the art.

Formation of Multiple Images:

In many applications, including proofing, color filter and electronic circuits, the textured receiver is processed using multiple imaging donors. This is the case when a multicolor image is built up or when numerous circuit lines are created on a single receiver. Thus, a first imaging donor is applied to the textured receiver, exposed and separated as described above. The receiver element has an image formed from the first imaging donor. Thereafter, a second imaging donor which can be the same or different from that of the first imaging donor forms a laserable assemblage with the textured and imaged receiver and is imagewise exposed and separated as described above. The steps of (a) forming the laserable assemblage with an imaging donor and the previously imaged and textured receiver, (b) exposing, and (c) separating are sequentially repeated as often as necessary in order to build desired pattern.

A final object produced by thermal imaging comprises a receiver element and specifically arranged material(s) deposited on or into the receiver element by means of thermal transfer. The transferred material(s) of the final object may be arranged in layer(s) directly upon the receiver element; layers of transferred materials may be completely or partially stacked or overlapped upon the receiver element; and transferred materials may diffuse partially or completely through the receiver element or the final object.

Color Filters

A specific embodiment of the invention is the creation and use of a color filter element. Color filters can be prepared utilizing two different versions of thermal imaging equipment. The first is a conventional drum type imager such as a Creo Model 3244 Spectrum Trendsetter (Creo Inc., Vancouver, Canada) equipped with a 20 W laser head operating at a wavelength of 830 nm, suitable for imaging of flexible receivers. A second kind of imager (the "flatbed") employs an identical imaging head, but based on a flatbed format rather than the Trendsetter drum format. The flatbed imager is preferred for exposure of relatively rigid, flat samples. The sample to be exposed is mounted using vacuum hold down to a translation stage positioned below the imaging head. During exposure the sample is typically translated past the imaging head at a speed of 1.0–1.2 m/s. Following the completion of each exposure pass, the imaging head is translated in the direction orthogonal to the sample translation to move a new unexposed area of film in front of the laser for the next imaging pass. This process is repeated to build up the completed exposure. As in the drum imager, the desired three-color image is prepared by sequentially exposing the red, blue and green donors to the same receiver element in any order desired.

During imaging exposure of the thermally imageable elements by the imaging laser, the ambient environment is preferably maintained from about 35 to about 45 percent relative humidity and from about 20 to about 24 degrees Centigrade.

Following the transfer of thermally imaged material such as a color filter pattern to the receiver that is typically glass or glass with a photolithographically produced mask.

Color filters can be incorporated into functional active matrix liquid crystal display devices using techniques which are well known within the liquid crystal display industry (see, for instance "Fundamentals of Active-Matrix Liquid-Crystal Displays", Sang Soo Kim, Society for Information Display Short Course, 2001; and "Liquid Crystal Displays: Addressing Schemes and Electro-optical Effects", Ernst Lueder, John-Wiley, 2001; and U.S. Pat. No. 5,166,026).

FIG. 8 shows a simplified schematic diagram of multilayer objects, specifically color filters of the prior art and of the present invention. FIG. 8*a* shows a portion of a prior art color filter (710) which includes a receiver of transparent glass (720) and an opaque black mask (730). A transparent, red-filtering layer (740) is applied using an assemblage of the receiver and a donor of a transparent, red-filtering imaging material layer. Rays of blue light (750) are transmitted through the transparent glass but not through the black mask nor through the red-filtering layer. Rays of red light (760) are transmitted through the transparent glass and the red-filtering layer.

FIG. 8*b* shows a color filter (770) according to this invention including a texturing layer (780). The texturing material of the texturing layer is situated on the opaque black mask, having been transferred in a first assemblage. In a subsequent assemblage, a transparent, red-filtering layer (740) is transferred so as to cover the texturing layer of the textured receiver.

FIG. 8*c* shows a color filter (790) according to this invention that includes a receiver of transparent glass (720) lacking an opaque black mask. The texturing material of the texturing layer (680) is situated on the transparent glass, having been transferred in a first assemblage. A transparent, red-filtering layer (740) is applied using an assemblage of the textured receiver and a donor of a transparent, red-filtering imaging material layer. Subsequently, an opaque black mask (630) is transferred onto the object. Rays of red light (760) are transmitted through the transparent glass and the red-filtering layer, but are blocked by the opaque black mask. In FIG. 8, a useful color filter can be constructed regardless of whether the texturing layer is transparent, translucent, or opaque, by appropriate choice of the position of the texturing layer location so as to not interfere with the required function of the red-filtering layer and the opaque black mask.

Figure 8D:
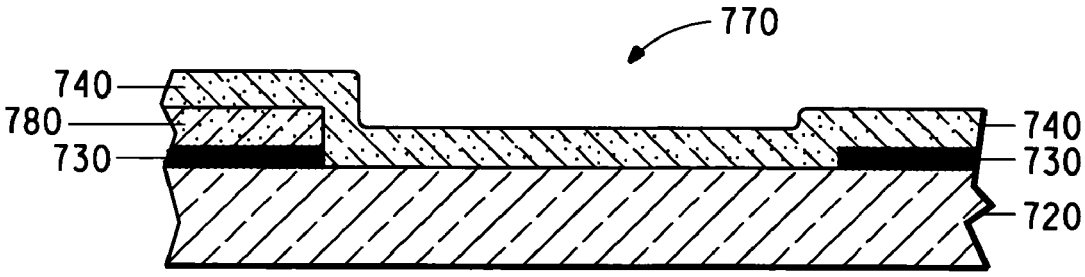

FIG. 8*d* shows a color filter (790) according to this invention including a texturing layer (780). The texturing material of the texturing layer is situated on the entire surface of the opaque black mask, having been transferred in a first assemblage. In a subsequent assemblage, a transparent, red-filtering layer (740) is transferred so as to cover the texturing layer of the textured receiver.

Figure 8E:
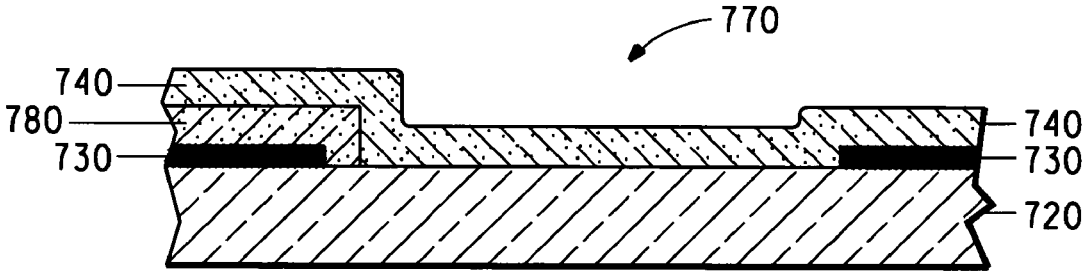

FIG. 8*e* shows a color filter (790) according to this invention including a texturing layer (780). The texturing material of the texturing layer is situated on the entire surface of the opaque black mask and a portion of the window area, having been transferred in a first assemblage. In a subsequent assemblage, a transparent, red-filtering layer (740) is transferred so as to cover the texturing layer of the textured receiver.

Figure 8F:
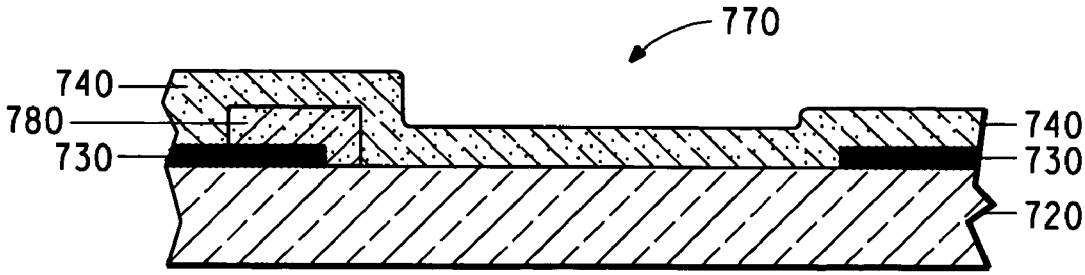

FIG. 8*f* shows a color filter (790) according to this invention including a texturing layer (780). The texturing material of the texturing layer is situated on a portion of the opaque black mask and a portion of the window area, having been transferred in a first assemblage. In a subsequent assemblage, a transparent, red-filtering layer (740) is transferred so as to cover the texturing layer of the textured receiver.

Figure 8G:
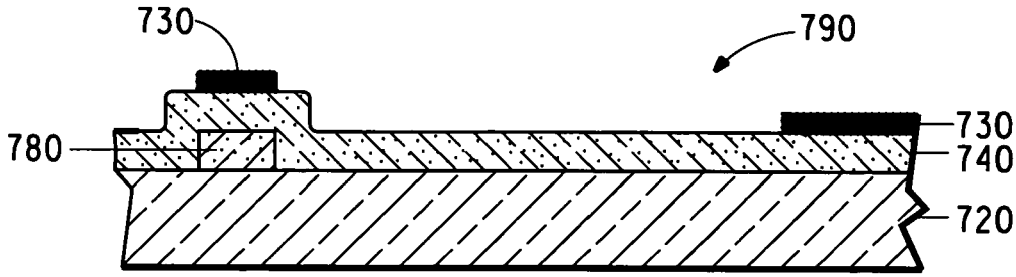
Figure 8H:
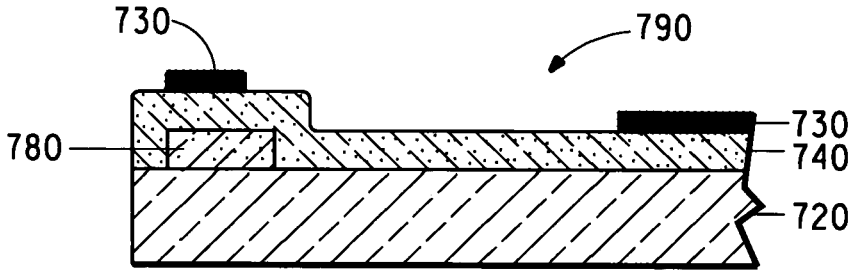
Figure 8I:
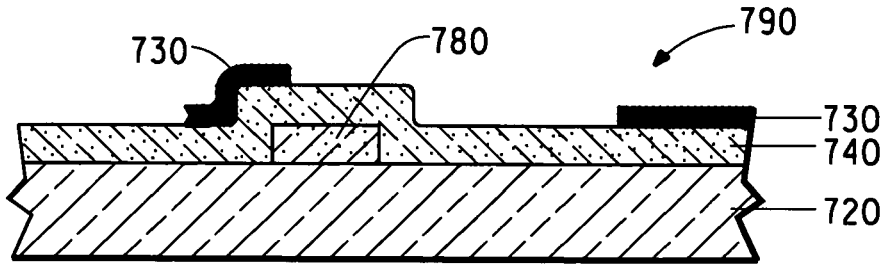

FIG. 8*g* shows a color filter (790) according to this invention that includes a receiver of transparent glass (720) lacking an opaque black mask. The texturing material of the texturing layer (780) is situated on the transparent glass, having been transferred in a first assemblage. A transparent, red-filtering layer (740) is applied using an assemblage of the textured receiver and a donor of a transparent, red-filtering imaging material layer. Subsequently, an opaque black mask (730) is transferred onto the object. FIG. 8*g* shows the texturing layer transferred to the entire latent opaque black mask area. FIG. 8*h* shows the texturing layer transferred to the entire latent mask area and at least a portion of the window area. FIG. 8*i* shows the texturing layer transferred to a portion of the latent black mask area and a portion of the window area.

When the texturing material is transferred to (a) at least one of the latent mask area and the present mask area or (b) one of the mask areas and a portion of the window area the texturing material is preferably either a colorless material or a pigment colorant that is the same as the pigment colorant that will be utilized as the colorant for the filtering layer. For example, if the pigment colorant for the filtering layer is a red transparent pigment colorant then the texturing material can be a red transparent pigment colorant.

Similarly, when the texturing material is transferred to no more than a portion of the window area and at least a portion of at least one of the latent and present mask areas the texturing material is preferably colorless material or a transparent pigment colorant that is the same as the transparent pigment colorant that will be utilized as the pigment colorant for the filtering layer. In this manner, the texturing material, in the widow areas, will not interfere with the function of the color filtering layer.

The following examples using well known materials can be used to illustrate the improvements of the invention by providing comparative objects.

COMPARATIVE EXAMPLE 1

A, B, and C

A known XGA color filter can be made using as a receiver element support a transparent sheet of Corning 1737 glass, 30.5696 cm wide by 23.4272 cm high by 0.7 mm thick. A color filter active area 28.5696 cm wide by 21.4272 cm high can be centered on the sheet, so as to have a 1 cm border around the active area. The active area can be filled by square pixels with sides of 279 microns in length, therefore having 1024 columns of pixels across the active area, and 768 rows of pixels down the height, for a total of 786,432 pixels. Each square pixel can have 3 windows for transmission of light to be filtered, each window being a 6 sided Figure of sides of length of respectively (from the top, horizontal side) 69 microns across to the right, 255 microns down, 48 microns across to the left, 21 microns up, 21 microns across to the left, and 234 microns up, where all sides are joined at a ninety degree angle. Each window therefore would have an area of 17,154 microns squared ($10^{-12}$ $M^2$). Each window would be separated from neighboring windows by a distance of at least 24 microns, and from the edge of the active area by at least 12 microns; and exactly 2,359,296 windows would be found within the active area. The windows differ from a simple rectangular shape 69 microns wide by 255 microns in height due to the presence of a opaque thin film transistor area, shaped as a square of 21 microns width and height. In each pixel, the leftmost window could be designated for filtering light to produce red light; the center window could be designated for filtering light to produce blue light, and the rightmost window could be designated for filtering light to produce green light.

A known receiver element having a chromium black mask could be made from the transparent sheet of Corning 737 glass. Chromium could be sputtered onto one of the 30.5696 cm wide by 23.4272 cm high sides of the transparent sheet to achieve a uniform chromium coating of 100 microns in thickness on the side which can now be designated as a masked side. Photolithographic techniques could be used to define the hexagonal windows in the pixels on the masked side by removal of chromium, leaving the chromium black mask defining the above mentioned 2.3+ million windows.

A known receiver element having a black mask such as an organic-film black mask could be made from the transparent sheet of Corning 737 glass. An opaque black layer of 1 micron in thickness could be made on one of the 30.5+ cm wide by 23.4+ cm high sides of the glass from a coating comprising carbon black such as a black dry-film resist on the side which can now be designated as a masked side. Photolithographic techniques could be used to remove the organic black layer from the hexagonal window areas, leaving the organic-film black mask defining the above mentioned 2.3+ million windows. Alternatively, a thermal-imaged black mask could be made on the transparent sheet of Corning 737 glass using a donor element having a opaque black transferable material layer of 1 micron in thickness, imaged with a pattern for transferring the opaque black transferable layer to the masked side, without material being transferred within the 2.3+ million window areas.

Exposure of an assemblage to produce an object such as a color filter can be accomplished by many known techniques, including utilizing one of two different versions of laser-based exposure equipment. The first is a conventional drum type imager comprising a Creo Model 3244 Spectrum Trendsetter (Creo Inc., Vancouver, Canada) equipped with a 20 W laser head operating at a wavelength of 830 nm, suitable for production of color proofs and flexible receivers. Assemblages can be exposed from the donor element side through or onto a transparent, transmitting, opaque or translucent donor element support. Films can be mounted using vacuum hold down to a standard plastic carrier plate clamped mechanically to a drum. Control of the laser output is typically under computer control to build up the desired exposure pattern on the spinning drum. The required three colors of the final filter can be built up by sequentially exposing a red, green and blue donor element in separate assemblages each comprising the same original receiver element. The exposure order for the color donor elements in the assemblages can be varied according to other system requirements (e.g. optimal exposure characteristics).

A second exposure method (the "flatbed") employs an identical imaging head comprising a laser for exposure, but is based on a flatbed format rather than the Trendsetter drum format. The flatbed exposure unit is preferred for exposure of a relatively rigid, flat assemblage such as those comprising a sheet of glass. The assemblage to be exposed can be mounted using vacuum hold down to a translation stage positioned below the imaging head. During exposure, in one exposure pass of a plurality, the sample can be translated past the imaging head to expose one of a single or group of row(s) or column(s) of windows (the laser illuminating and exposing the assemblage continuously or intermittently). Following the completion of each exposure pass, the imaging head could be translated in the direction orthogonal to the assemblage translation to move a new unexposed area of assemblage in front of the laser for the next imaging pass using translation in the opposite direction during exposure. This process is repeated as necessary to build up the completed exposure of the assemblage. As in the drum exposure unit, the desired three color object can be prepared by sequentially exposing red, blue and green donors in different assemblages comprising the same receiver element.

Suitable donor elements for both texturing and functional materials include donor elements known in the art, e.g. proofing donors such as Black donor element H71081, Magenta donor element H71014, Cyan Donor element H70980, Yellow donor element H71030, from E. I. DuPont de Nemours, DuPont Electronics and Communications Technologies, Wilmington, Del.

Known patterns of exposure can be used. One known pattern, which can be used for a transparent texturing material or a colored functional material for an assemblage for a color filter, is a pattern of stripes. A pattern of stripes, suitable for a color filter comprising the above Corning 1737 glass receiver element, can comprise 1024 stripes, each 93 microns wide and 21.4272 cm high, at a pitch of 279 microns. The width of the pattern is 285,510 microns from the left edge of the leftmost stripe to the right edge of the rightmost stripe. When a first assemblage of a Corning 1737 glass receiver element (and optionally a mask) and a red transparent donor element is exposed to the pattern of stripes within the active area and starting at the leftmost edge of the active area, a known exposed assemblage comprising a red filter including the glass can be produced with red transparent material covering 786,432 window areas of the glass and at least a 12 micron band and the thin film transistor areas surrounding and adjacent to those windows. Removal of the spent red donor element and construction of a new assemblage of the red filter with a blue donor element makes a second assemblage comprising the original glass.

The second assemblage can be exposed to the same pattern of stripes, offset 93 microns to the right of the left edge of the active area, to transfer a second independent set of stripes of blue, one each to the right of each red stripe, covering 786,432 window areas of the glass and at least a 12 micron band and the thin film transistor areas surrounding and adjacent to those windows, thereby creating a red and blue filter. In a perfect transfer, the blue stripes will theoretically abut but not overlap the red stripes. Removal of the spent blue donor element and construction of a new assemblage of the red and blue filter with a green donor element makes a third assemblage comprising the original glass.

The third assemblage can be exposed to the same pattern of stripes, offset 186 microns to the right of the left edge of the active area, to transfer a third independent set of stripes of green, one each to the right of each blue stripe and 1023 to the left of a red stripe, covering 786,432 window areas of the glass and at least a 12 micron band and the thin film transistor areas surrounding and adjacent to those windows, thereby creating a red, blue and green filter (a known three color filter) in the assemblage. In a perfect transfer, the green stripes will abut but not overlap 1023 red stripes and the 1024 blue stripes. Removal of the spent green donor element reveals a final object, the known three color filter.

Visible defects in successful transfer to the glass receiver are counted after separation of each layer. For the first assemblage in comparison to the second, there would be an average of 5 times as many defects visible to the naked eye-around 10 to 2.

Comparative Example 1A can be made from Corning 1737 glass with a chrome black mask. Comparative Example 1B can be made from Corning 1737 glass with an organic black mask. Comparative Example 1C can be made from Corning 1737 glass without a black mask. In Examples 1A and 1B, the donor elements would always placed on the masked side of the receiver element in forming each assemblage. In Example 1C, the donor elements would all be placed on the same side of the receiver element in each assemblage.

PROPHETIC EXAMPLE 2

A color filter in accordance with this invention can be made using a texturing transfer of a texturing material according to a texturing pattern. One embodiment of a texturing pattern is designed to place texturing material into the vicinity of the thin film transistor area of a receiver element comprising Corning 1737 glass with a chrome black mask as in Comparative Example 1A.

A first thin-film-transistor-area-partial-covering texturing pattern can comprise a pattern of 2,359,296 identical square areas 27 microns on each side, arranged in 3072 columns of 768 rows. The pitch of the rows would be 279 microns; the pitch of the columns would be 93 microns. The pattern would be exposed within the active area so that the leftmost column of the pattern abuts the leftmost edge of the active area, and the topmost edge of the top row of the pattern is 252 microns below the top edge of the active area. This pattern is intended to cover a square portion of the thin-film-transistor-area, 15 microns on each side, and have texturized areas spaced at least 6 microns from the closest window (that abuts the thin-film-transistor-area) and at least 12 microns from the next closest window (typically to the left).

This pattern has an advantage in the manufacture of a color filter because the texturing pattern will be completely on the black mask (when a black mask is present), so that no light will be transmitted through the texturing transferred material in the final color filter. The color and transparency of the first donor will have no effect on the required useful properties of the color filter as contributed by subsequent donors.

A donor element comprising a support of 25 micron polyester with an 0.1 micron chrome light-to-heat layer contacting a 1 micron thick transfer material for thermal mass transfer can be used. The donor element thermal transfer material could comprise a red pigment, and be suitable for manufacturing a red filter of a color filter.

An assemblage would be made with the chrome black mask of the receiver element contacting the red thermal transfer material of the first donor element. Exposure would transfer red material to the receiver element. Separation of the spent donor element would provide a textured receiver element. The textured receiver element would be used as in comparative Example 1A in three subsequent assemblages to receive red, blue, and green transfer material over the appropriate windows. After separation of the final assemblage, an inventive color filter is obtained.

PROPHETIC EXAMPLE 3

A color filter in accordance with this invention can be made using a texturing transfer of a texturing material according to a texturing pattern. One embodiment of a texturing pattern is designed to place texturing material into the vicinity of the thin film transistor area of a receiver element comprising Corning 1737 glass with a organic black mask as in Comparative Example 1B, using only one third of the number of areas of the texturing pattern used in example 2.

A sparse first thin-film-transistor-area-partial-covering texturing pattern can comprise a pattern of 786,432 identical square areas 27 microns on each side, arranged in 1024 columns of 768 rows. The pitch of the rows and the columns would be 279 microns.

Other than the sparse pattern to be used in Example 3 and the receiver element having an organic black mask instead of a chrome black mask, the example is identical to Example 2.

PROPHETIC EXAMPLE 4

A color filter in accordance with this invention can be made using a texturing transfer of a texturing material according to a texturing pattern. One embodiment of a texturing pattern is designed to place texturing material into the designated window area of a receiver element comprising Corning 1737. The receiver element could optionally comprise a black mask, or a black mask could be added in a subsequent step, including an organic black mask being added in a thermal imaging step. This example starts with bare glass as in Comparative Example 1C, and adds an organic black mask after texturing and before the use of the three colored donor elements. The texturing donor material is transparent so that it has no positive or negative effect on the filtering properties of the final color filter, regardless of its presence or absence.

A window-occupying texturing pattern can comprise a pattern of 786,432 identical rectangular areas 29 microns wide and 93 microns high, arranged in 1024 columns of 768 rows. The pitch of the rows and the columns would be 279 microns. The pattern would be exposed within the active area so that the leftmost column of the pattern is 32 microns to the right of the leftmost edge of the active area, and the topmost edge of the top row of the pattern is 100 microns below the top edge of the active area. This pattern is intended to occupy a rectangular portion of the leftmost window area of a pixel, while being at least 20 microns distant from the black mask in the final color filter.

This pattern has an advantage in the manufacture of a color filter because the preferred texturing material will be transparent and uncolored. The color and transparency of the texturing donor will have no effect on the required useful properties of the color filter as contributed by subsequent donors, whether the intended transfer is successful or not.

A donor element comprising a support of 25 microns thick polyester film with an 0.1 micron chrome light-to-heat layer contacting a 1 micron thick transfer, transparent, colorless material for thermal mass transfer can be used.

After routine construction of a first assemblage of the Corning 1737 glass and a colorless transparent material donor element, exposure, and separation, a textured glass receiver element without a black mask would be obtained. A next step of making an assemblage of the textured glass receiver element with a black material donor element could be used with a black mask pattern of exposure to obtain a textured receiver element having a black mask. This element could be converted to a color filter as above.

Evaluation of the Examples

The examples above can be evaluated by eye and with a 20× magnifier for imperfections. The number of imperfections could be classified as none, few (less than 10, none so extreme as to prevent use), some (10 to 50 defects, 1–9 which would prevent use), and many (more than 50 defects, or 10 or more which would prevent use). The comparative examples would be expected to show some or many imperfections; the examples of the invention would be expected to show few or no imperfections.

What is claimed is:

1. In a method for thermally transferring an imaging layer comprising a binder and an imaging material that includes a particles of pigment from an imaging donor to a receiver to form a pattern of the imaging material on the receiver wherein the improvement comprises thermally transferring a transparent colorless texturing material from a texturing donor to the receiver prior to thermally transferring the imaging material to the receiver.

2. The method of claim 1 in which the receiver comprises a glass substrate.

3. In a method for the manufacture of a color filter element comprising thermally mass transferring a pigment colorant from a thermal mass transfer colorant donor to a substrate to form a pattern of at least one color on the substrate, wherein the improvement comprises:

thermally mass transferring a transparent colorless texturing material from a thermal mass transfer texturing donor to the substrate prior to thermal mass transfer of the pigment colorant.

4. In a method for the manufacture of a color filter element, comprising thermally transferring using a laser a colorant from an imaging donor to a substrate, wherein the improvement comprises:

thermally transferring using a laser a transparent colorless texturing material from a texturing donor to the substrate prior to thermal mass transfer of the colorant.

5. In a method for the manufacture of a color filter element comprising a layered substrate comprising a transparent substrate and an opaque mask with an opaque masked side and windows defined by the mask, comprising thermally transferring using a laser a colorant from an imaging donor to the layered substrate on the opaque masked side so as to cover a subset of the windows, wherein the improvement comprises:

thermally transferring using a laser an area of transparent colorless texturing material from a texturing donor to the layered substrate on the opaque masked side prior to transfer of the colorant; wherein the area covers only a portion of the opaque mask.

6. In a method for the manufacture of a color filter element comprising a partially transparent substrate with an opaque masked side and windows defined by the mask, comprising thermally transferring using a laser a colorant from an imaging donor to the substrate on the opaque masked side so as to cover a subset of the windows, wherein the improvement comprises:

thermally transferring using a laser an area of transparent colorless texturing material from a texturing donor to the substrate prior to transfer of the colorant; wherein the area covers a portion of the opaque mask and a portion of one of a window and windows, and does not cover any complete window.

* * * * *